US005725199A

United States Patent [19]

Yamamoto

[11] Patent Number: 5,725,199

[45] Date of Patent: Mar. 10, 1998

[54] AIR HOIST INCLUDING BRAKE FEATURE

[75] Inventor: Katsuji Yamamoto, Miyaki-gun, Japan

[73] Assignee: Toku Pneumatic Tool Mfg. Co., Ltd., Saga, Japan

[21] Appl. No.: 642,004

[22] Filed: May 2, 1996

[30] Foreign Application Priority Data

Jul. 12, 1995 [JP] Japan ..... 7-176321

[51] Int. Cl.[6] ..... B66D 1/10

[52] U.S. Cl. ..... 254/360; 254/379

[58] Field of Search ..... 254/360, 379, 254/375

[56] References Cited

U.S. PATENT DOCUMENTS

| | | | |
|---|---|---|---|
| 3,035,414 | 5/1962 | Smith | 254/379 X |
| 4,243,060 | 1/1981 | McKendrick | 254/360 X |
| 4,434,974 | 3/1984 | LaCount | 254/379 X |
| 4,566,675 | 1/1986 | Kotone et al. | 254/360 |
| 5,465,939 | 11/1995 | Sell | 254/360 X |
| 5,522,581 | 6/1996 | Kulhavy | 254/360 X |

*Primary Examiner*—John P. Darling
*Assistant Examiner*—Emmanuel M. Marcelo
*Attorney, Agent, or Firm*—Jordan and Hamburg

[57] ABSTRACT

A winding machine, useful as an air hoist, includes a winding portion about which a chain is wound, and from which articles are hung for loading and/or unloading thereof. The winding machine is rotationally powered by an air driven motor controlled by an air supply valve which regulates the supply of air to the motor by virtue of a built-in variable shuttle valve. An operation unit pneumatically biases a main spool in the shuttle valve in a desired direction and to a selected extent to provide, respectively, rotation in normal and reverse directions, by permitting adjustable flow-through of air from a supply line. A rotation suspending mechanism includes an air activated braking mechanism, normally biased to provide braking of the motor when not actively being rotationally operated. The braking mechanism is connected through a variable aperture to the air supply, such that sufficient air pressure provided thereto overcomes the biasing thereof. The opening in the variable aperture is determined by operation of a braking valve in communication with the operation unit via air flow passages, to variably operate the braking valve based upon flow of air through the shuttle valve of the operation unit, thereby disengaging the brake mechanism when sufficient air pressure is supplied to rotate the air driven motor.

4 Claims, 7 Drawing Sheets

AIR HOIST INCLUDING BRAKE FEATURE

BACKGROUND OF THE INVENTION

1. Field of the Invention

The present invention relates to a winding machine and, more particularly, to a winding machine using high-pressure air as a power source so adapted as to be remotely controlled with ease.

2. Description of the Related Art

As a type of winding machines using high-pressure air as a power source, there may be enumerated, for example, an air hoist and an air chain block. The air chain block comprises a winding portion having a chain for hanging goods wound therein, an air motor for rotating the winding portion by means of the high-pressure air to be supplied from an air supply source, and an air amount adjustment mechanism interposed between the air motor and the air supply source for adjusting the amount of the air to be supplied to the air motor.

A such air amount adjustment mechanism contains an air supply valve that in turn is provided with a spool and an amount of air to be supplied to the air motor from the air supply source is determined by controlling the amount of a sliding movement of the spool. The sliding movement of the spool is controlled mechanically, for example, by means of a lever or a cam.

The air chain block is further provided with an overload prevention function capable of preventing an overload of the air motor. The overload prevention function generally comprises a detection means for detecting the overload of the air motor and a suspending means for suspending the rotation of the winding portion.

The detection means may be broken down into two types: a first type being of such a type as detecting a transformation of an elastic member in accordance with the load and a second type being of such a type as detecting an operating pressure of the air motor in accordance with the load. On the other hand, the suspending means may be broken down into two types: a first type being of such a type as blocking an air supply source for supplying air to the air motor and a second type being of such a type as operating a brake.

The air amount adjustment mechanism of a conventional type for controlling the amount of air in such a mechanical way as sliding the spool of the air supply valve, however, renders remote control of the winding machine difficult from the structural point of view.

On the other hand, the overload prevention function of the type detecting the transformation of the elastic member in accordance with the load suffers from the disadvantage that the detection means itself undergoes a load so that the detection means has to be made larger in scale as the ability of winding goods is made higher enough to withstand a heavier load.

The overload prevention function of the type detecting the operating pressure of the air motor in accordance with the load suffers from the disadvantage that a detection means having a high sensitivity is required because a slight variation in pressure should be detected. Therefore, the use of such a sensitive detection means is made it difficult to realize the very sensitive function of this type from the technical point of view as well as from the cost performance point of view.

As the suspending means, the type capable of blocking the air supply source to the air motor requires a large-scale equipment, such as a large shut-off valve, in order to block a supply of a large amount of high-pressure air, thereby leading to a large scale of the suspending means and eventually to a large scale of the winding machine.

The suspending means of the type as operating the brake, however, suffers from the disadvantage that a brake structure of a mechanical type makes responsiveness poor, on the one hand, and a brake structure of an air pressure type makes its structure complicated because a shut-off valve or the like is required, as this type generally adopts the type of blocking the pressure for releasing the brake.

Therefore, for the conventional winding machines such as the air chain blocks, it is difficult to control them remotely and to make the overload prevention function highly sensitive.

SUMMARY OF THE INVENTION

The present invention has the object to provide a winding machine that can solve the problems and disadvantages prevailing in the conventional winding machines.

The present invention has another object to provide a winding machine so adapted as to be controlled remotely with ease.

Further, the present invention has an object to provide a winding machine so adapted as to make an overload prevention function highly sensitive.

In order to achieve the objects as described hereinabove, the present invention provides a winding machine comprising: a winding portion having a chain wound therein for hanging goods; an air supply source; an air motor for rotating said winding portion by air to be supplied from said air supply source; and an air amount adjustment mechanism for controlling a speed of rotation of said air motor interposed between said air motor and said air supply source; wherein said air amount adjustment mechanism comprises an air supply valve and an operation unit; and wherein said air supply valve comprises a variable aperture; an air flow passage connecting said air supply source to said air motor through said variable aperture; and a spool disposed so as to slide therein; in which an opening of said variable aperture is variable in accordance with an amount in which said spool slides; and wherein said operation unit is disposed to slide said spool by supplying air to said air supply valve from said air supply source through a variable valve disposed therein so as to be variable in an opening area thereof.

Further, the present invention provides the winding machine which further comprises a rotation suspending mechanism for suspending rotation of said air motor; wherein said rotation suspending mechanism comprises a brake portion and a braking valve; in which said brake portion is provided with a brake piston biased so as to press a braking plate mounted on an end portion of a rotary shaft of said air motor and to be released from pressing the braking plate by means of pressure of air and in which said braking valve has a brake spool disposed therein and an air flow passage connecting said air supply source to said brake portion through a variable aperture and having said air flow passage disposed therein so as to be variable in the opening area thereof through which air passes in an amount varying in accordance with an amount in which said brake spool slides.

Furthermore, the present invention provides a winding machine comprising: a winding portion having a chain wound therein for hanging goods; an air supply source; an air motor for rotating said winding portion by air to be supplied from said air supply source; an air amount adjustment mechanism for controlling a speed of rotation of said air motor interposed between said air motor and said air supply source; and a rotation suspending mechanism for suspending rotation of said air motor; wherein said air amount adjustment mechanism comprises an air supply valve and an operation unit; wherein said air supply valve comprises a variable aperture; an air flow passage connecting said air supply source to said air motor through said variable aperture; and a spool disposed so as to slide therein; in which an opening of said variable aperture is variable in accordance with an amount in which said spool slides; wherein said operation unit is disposed to slide said spool by supplying air to said air supply valve from said air supply source through a variable valve disposed therein so as to be variable in an opening area thereof; and wherein said rotation suspending mechanism comprises a brake portion and a braking valve; in which said brake portion is provided with a brake piston biased so as to press a braking plate mounted on an end portion of a rotary shaft of said air motor and to release pressing of the braking plate by means of pressure of air and in which said braking valve has a brake spool disposed therein and an air flow passage connecting said air supply source to said brake portion through a variable aperture and having said air flow passage disposed therein so as to be variable in the opening area thereof through which air passes in an amount varying in accordance with an amount in which said brake spool slides.

More specifically, the present invention provides the winding machine, wherein said air supply valve of said air amount adjustment mechanism has a cylinder having a chamber with the spool disposed so as to be slidable therein; the cylinder has a wall having said air flow passage connecting said air supply source to said air motor through the chamber thereof; and the variable aperture is disposed at a joint portion connecting the air flow passage to the chamber; and said operation unit of said air amount adjustment mechanism is provided with the variable valve for supplying air to the chamber of said air supply valve and an opening area of the variable valve is disposed so as to be variable in accordance with an amount in which the spool slides in the chamber of said air supply valve.

In addition, the present invention provides a winding machine, wherein the brake portion of said rotation suspending mechanism is provided with the brake piston biased so as to press the braking plate mounted on an end portion of the rotary shaft of said air motor and to release pressing of the braking plate by means of pressure of air; and the braking valve has a braking cylinder disposed therein; the brake spool disposed therein so as to be slidable in the cylinder chamber; an air chamber disposed in a wall portion thereof having a first air flow passage communicating with said air supply source and a second air flow passage communicating with the cylinder chamber; and the variable aperture disposed in the wall portion thereof connecting the cylinder chamber to the braking cylinder.

In the winding machine in accordance with the present invention, the operation unit is operated by pressing the operation lever to open the variable valve, such as a throttle valve, disposed therein and to supply air to the cylinder chamber of the air supply valve from the air supply source. The spool disposed in the air supply valve is caused to slide in the cylinder chamber by the pressure created by the air introduced into the cylinder chamber, thereby opening the variable aperture at the junction of the air flow passage disposed in the cylinder wall and the cylinder chamber. With this arrangement, the air can be supplied from the air supply source to the air motor in the amount corresponding to the opening area of the variable aperture for driving the air motor to wind the chain of the winding machine for raising or lowering goods.

In the winding machine having the structures as described hereinabove, the operation unit comprises an operation unit for rotating the air motor in a normal direction and an operation unit for rotating the air motor in a reverse direction.

The winding machine in accordance with the present invention having the arrangement as described hereinabove allows a smooth displacement of the spool and a ready adjustment of a speed of rotation of the air motor. Further, it can be so arranged as to perform the remote control of air in such an easy way.

Further, when the goods is being wound upwardly, a portion of the air supplied for rotating the air motor is fed to the cylinder chamber of the braking valve and allows the brake spool to slide in the cylinder chamber opening the variable aperture, thereby transferring the brake piston in the direction in which the braking is to be released and as a result making the braking force smaller so as to allow a smooth winding operation. On the other hand, when the operating pressure of the air motor exceeds a predetermined level of an overload, the brake spool is disposed to slide in the cylinder in accordance with the elevation of the operating pressure of the air motor, thereby decreasing the amount of the air to be fed to the braking cylinder and lowering the pressure for releasing a brake.

With this arrangement of the air motor, if the operating pressure of the air motor is caused to be elevated, the braking force can also be applied in addition to the load. If the operating pressure of the air motor would continue increasing, the braking force is allowed to increase, too, thereby eventually leading to the suspension of the air motor.

Other objects, features and advantages of the present invention will become apparent in the course of the description that follows, with reference to the accompanying drawings.

DESCRIPTION OF THE PREFERRED EMBODIMENTS

Figure 1:
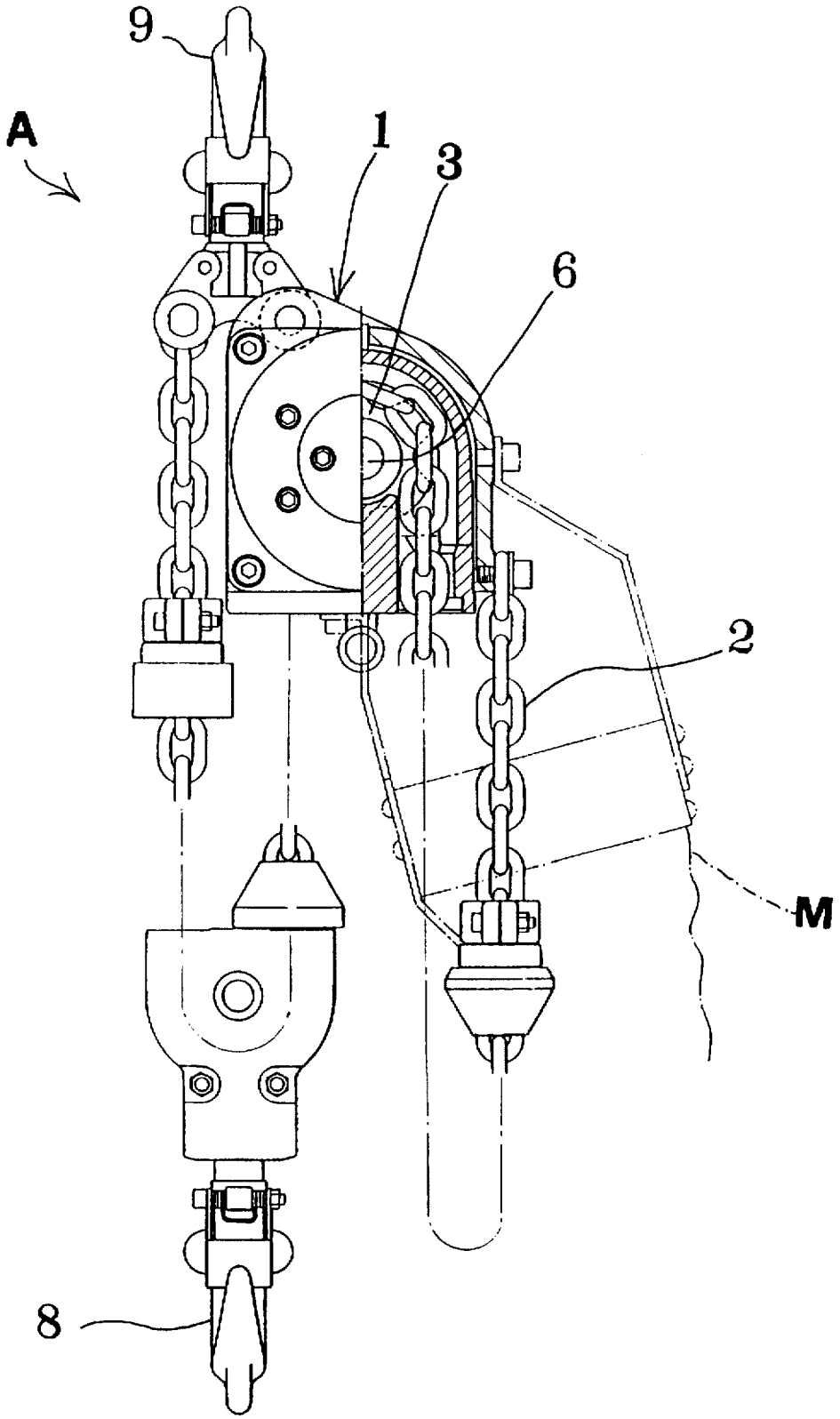
FIG. 1 is a partially sectional front view showing a winding machine in accordance with an embodiment of the present invention.
Figure 2:
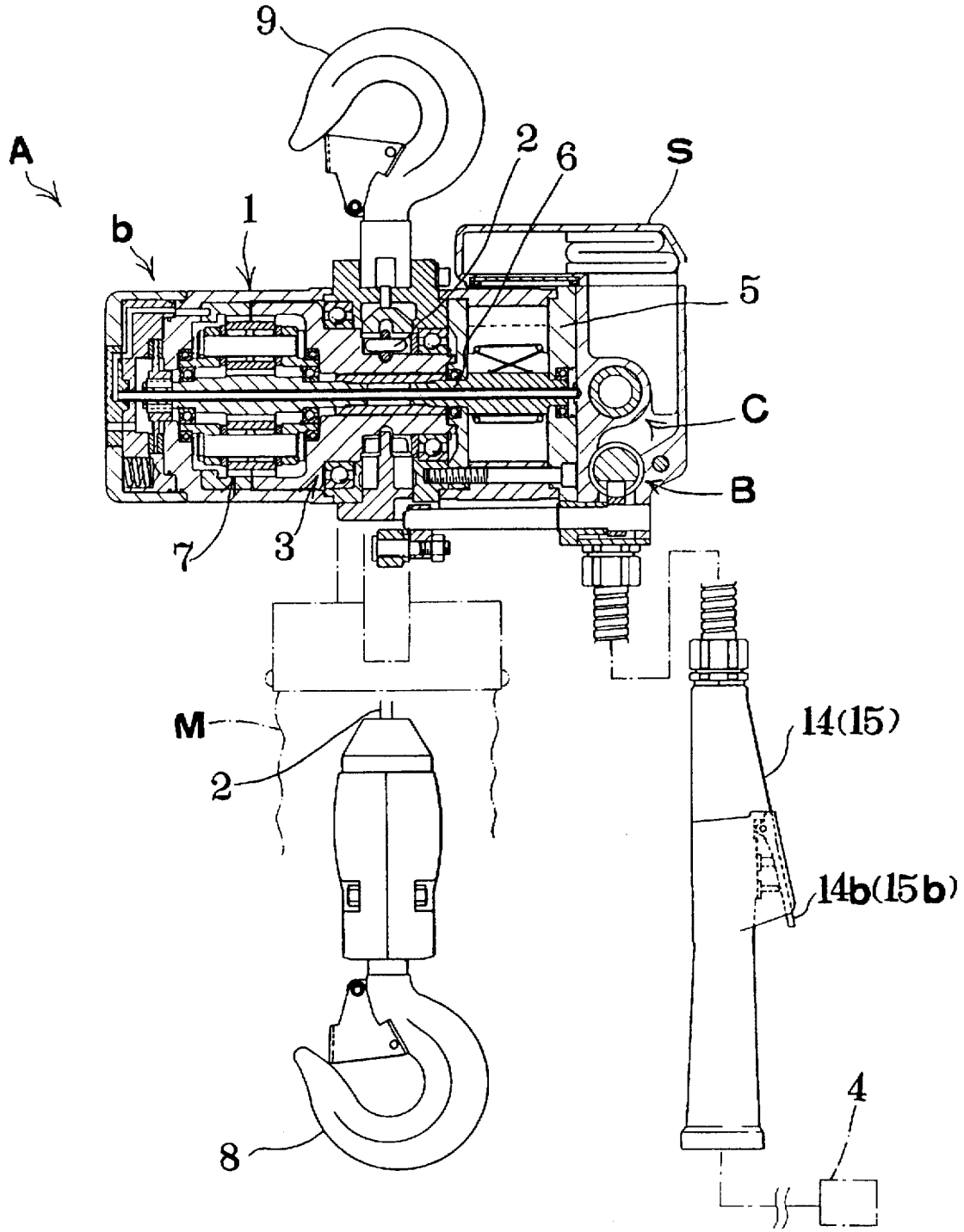
FIG. 2 is a partially sectional front view showing the winding machine of FIG. 1.
Figure 4:
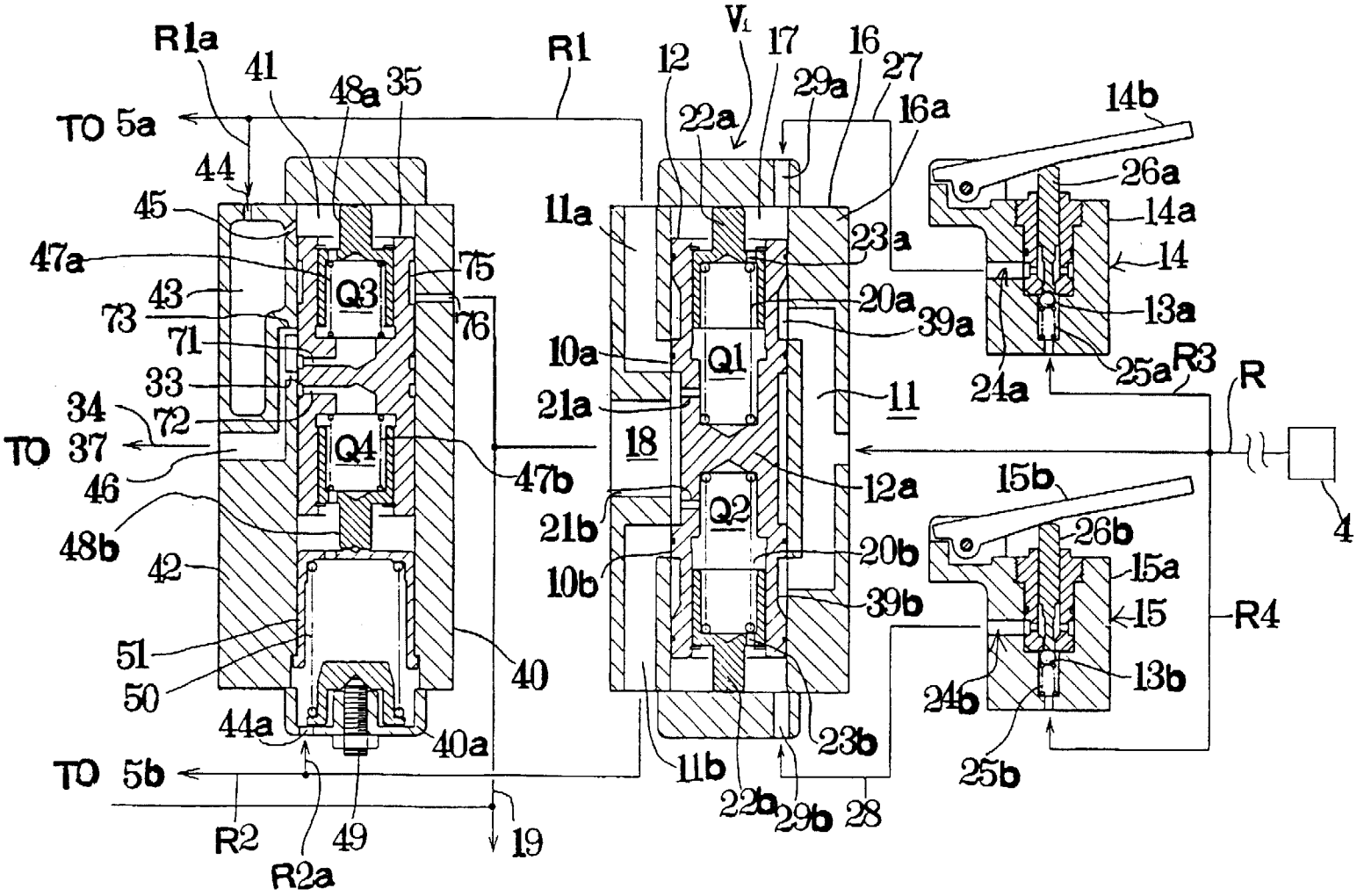
FIG. 4 is a sectional view showing an air amount adjustment mechanism B and a rotation suspension mechanism C of the winding machine according to the present invention.

As shown in FIGS. 1 and 2, a winding machine A according to an embodiment of the present invention comprises a casing 1, a chain 2 for hanging goods, a winding portion 3 disposed in the casing 1 with the chain 2 wound around its outer periphery, and an air motor 5 for rotating the winding portion 3 with high-pressure air supplied from an air supply source 4 (FIG. 4). In the drawings, reference numeral 8 denotes a hook disposed at a bottom of the chain 2 for hanging goods; reference numeral 9 denotes a hook for allowing the casing 1 to hang from a ceiling or the like; reference symbol M denotes a bag for accommodating the chain 2; and reference symbol S denotes a silencer.

As shown in FIG. 2, the air motor 5 comprises a rotary air motor capable of rotating in normal and reverse directions. To the air motor 5 is connected a rotary shaft 6 to a one end side of which in turn is connected a deceleration portion 7. The winding portion 3 is allowed to be rotated through the deceleration portion 7.

Figure 3:
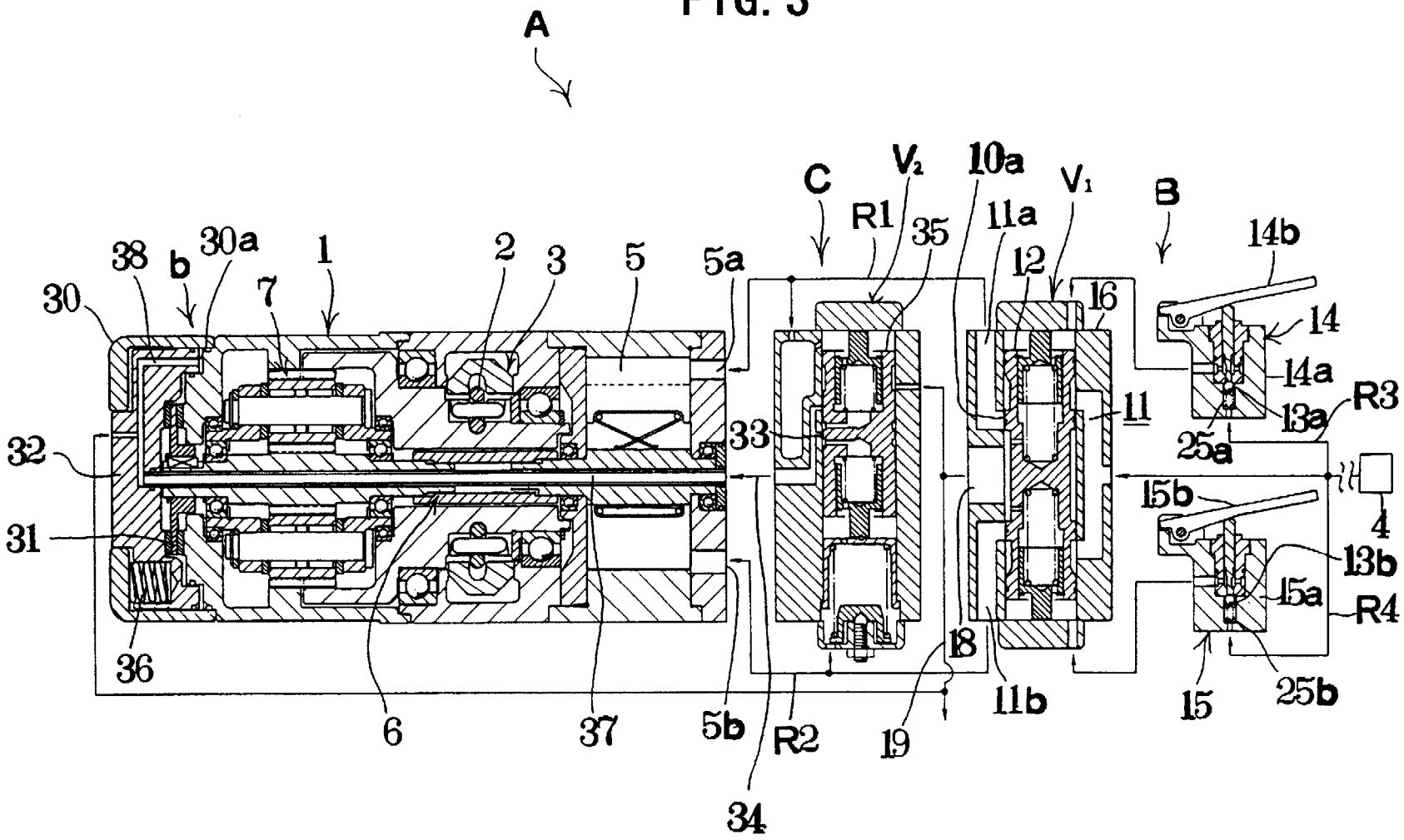
FIG. 3 is a sectional side view showing essential portions of a winding machine according to the present invention.

As shown in FIG. 3, an air amount adjustment mechanism B for controlling a speed of rotation of the air motor 5 and a rotation suspension mechanism C for suspending the rotation of the air motor 5 upon detection of an overload of the air motor are interposed between the air motor 5 and the air supply source 4.

With reference to FIGS. 3 and 4, a description will be made of specific structures of the air amount adjustment mechanism B and the rotation suspension mechanism C.

First, the structure of the air amount adjustment mechanism B will be described hereinafter with reference to FIGS. 3 and 4.

As shown in FIGS. 3 and 4, the air amount adjustment mechanism B comprises an air supply valve V1, a first operation unit 14, and a second operation unit 15. The air supply valve V1 is connected through a main air flow passage R to the air supply source 4 and likewise through a connection passage 27 to the first operation unit 14 that in turn is connected to the air supply source 4 through a first branch air flow passage R3 divided from the main air flow passage R. Further, the air supply valve V1 is connected through a connection passage 28 to the second operation unit 15 that in turn is connected to the air supply source 4 through a second branch air flow passage R4 divided from the main air flow passage R.

The first operation 14 is operated so as to rotate the air motor 5 in a normal direction, thereby raising goods by winding the chain 2 in an upward direction. On the other hand, the second operation 15 is operated so as to rotate the air motor 5 in a reverse direction, thereby lowering goods by winding the chain 2 in a downward direction.

As specifically shown in FIG. 4, the air supply valve V1 mainly comprises a cylinder 16 having a cylinder chamber 17 disposed at its central portion with a main spool 12 disposed 15 therein. The cylinder 16 has a thick peripheral side wall 16*a* that in turn is provided at its front side wall portion with a front-side air flow passage 11 and at its rear side wall portion with branch air flow passages 11*a* and 11*b* divided from the front-side air flow passage 11 as well as with a rear-side air flow passage 18. The front-side air flow passage 11 is in turn connected, on the one hand, to the air supply source 4 through the air flow passage R and it can be connected, on the other hand, to the branch air flow passages 11*a* and 11*b* via groove passages 39*a* and 39*b*, respectively, disposed on an outer peripheral surface of the main spool 12. More specifically, the front-side air flow passage 11 can communicate with the branch air flow passage 11*a* or 11*b* through the groove passage 39*a* or 39*b* of the main spool 12, respectively, as the main spool 12 slides in the cylinder chamber 17.

The main spool 12 is provided at its central portion with a partition 12*a* that defines and delimits one sides, i.e. inner sides, of first and second spaces Q1 and Q2, respectively. In the first and second spaces Q1 and Q2 are disposed spring mounts 22*a* and 22*b*, respectively, that define and delimit the other sides thereof. In the spring mounts 22*a* and 22*b* are in turn disposed springs 20*a* and 20*b*, respectively. More specifically, the first space Q1 is formed within the main spool 12 in association with the inner side surface of the spring mount 22*a*, the inner side wall surface of the main spool 12 and an inner wall surface of the partition 12*a* thereof. Likewise, the second space Q2 is formed within the main spool 12 on the opposite side in association with the inner side surface of the spring mount 22*b*, another inner side wall surface of the main spool 12 and another inner wall surface of the partition 12*a* thereof.

The cylinder chamber 17 disposed in the cylinder 16 communicates with the connection passage 27 through a through hole 29*a* disposed in a cylinder cap disposed on the cylinder 16 on the side on which the spring mount 22*a* is provided. The spring mount 22*a* is provided with a through hole 23*a* through which the cylinder chamber 17 in turn communicates with the first space Q1 in which the spring 20*a* is disposed. In the rear side wall portion of the main spool 12 is provided an through hole 21*a* that can connect the first space Q1 to the rear-side air flow passage 18. To the rear-side air flow passage 18 is connected a braking valve V2 and a discharging air flow passage 19. Like-wise, the second space Q2 communicates with the rear-side air flow passage 18 through an through hole 21*b* disposed in another rear side wall portion of the main spool 12. The second space Q2 further communicates with the cylinder chamber 17 via a through hole 23*b* disposed in a wall portion of the spring mount 22*b* and the cylinder chamber 17 on the side of the spring mount 22*b* further communicates with the connection passage 28 via a through hole 29*b* disposed in a cylinder cap disposed on the other side of the cylinder 16. The connection passage 28 is further connected to the second operation unit 15.

Although described hereinabove, the main spool 12 is further provided at its outer peripheral surface portions with groove passages 39*a* and 39*b*, that may form a halfway portion connecting the front-side air flow passage 11 to the branch air flow passages 11*a* and 11*b*, respectively, around the cylinder chamber 17, i.e. that may connect the front-side air flow passage 11 to the branch air flow passages 11*a* and 11*b*. In other words, the branch air flow passage 11*a* is connected through the groove passage 39*a* to inlet 5*a* of the air motor 5 for rotating the air motor 5 in a normal direction. On the other hand, the branch air flow passage 11*b* is connected through the groove passage 39*b* to an inlet 5*b* of the air motor 5 for rotating the air motor 5 in a reverse direction.

At the connections of the branch air flow passages 11*a* and 11*b* to the cylinder chamber 17 are disposed variable apertures 10*a* and 10*b*, respectively. The variable apertures 10*a* and 10*b* are disposed so as to open upon a slidable movement of the main spool 12. More specifically, on the one hand, when the main spool 12 is caused to slide in the direction in which to open the variable aperture 10*a*, that is, in the downward direction, as seen in FIG. 4, by supplying the air to the cylinder chamber 17 via the connection passage 27 from the first operation unit 14, the air is allowed to pass through the variable aperture 10*a* from the front-side air flow passage 11 through the groove passage 39*a*. The air passing through the variable aperture 10*a* is then fed from the air supply valve V1 to the inlet 5*a* of the air motor 5 through the connection passage R1.

On the other hand, when the main spool 12 is caused to slide in the direction in which to open the variable aperture 10b, that is, in the upward direction, as seen in FIG. 4, by supplying the air to the cylinder chamber 17 via the connection passage 28 from the second operation unit 15, the air is allowed to pass through the variable aperture 10b from the front-side air flow passage 11 through the groove passage 39b. The air passing through the variable aperture 10b is then fed to the inlet 5b of the air motor 5 through the connection passage R2.

Then, a description will be made of the first operation unit 14 and the second operation unit 15 with reference to FIGS. 3 and 4.

As shown in FIGS. 3 and 4, the first operation unit 14 comprises a main body 14a having an through hole 24a, a variable throttle valve 13a disposed on a half way of the through hole 24a so as to be opened or closed by the operation of an operation lever 14b, a spring 25a biased so as to close the variable throttle valve 13a, and an operation rod 26a having its one end abutting with the variable throttle valve 13a and its other end abutting with an operation portion of the operation lever 14b. The through hole 24a extends from an inlet communicating with the branch air flow passage R3 divided from the main air flow passage R connected to the air supply source 4, on the one hand, to an outlet communicating with the connection passage 27. The operation rod 26a is disposed so as to allow the inlet of the through hole 24a to communicate with the outlet thereof, when the throttle valve 13a is pressed in resistance to the spring 25a by pressing the operation lever 14b, thereby opening the through hole 24a and allowing the air to pass through the hole 24a from the air supply source 4 to the connection passage 27.

Likewise, the second operation unit 15 has substantially the same structure as the first operation unit 14. In other words, the second operation unit 15 comprises a main body 15a having an through hole 24b, a variable throttle valve 13b disposed on a half way of the through hole 24b so as to be opened or closed by the operation of an operation lever 15b, a spring 25b biased so as to close the variable throttle valve 13b, and an operation rod 26b having its one end abutting with the variable throttle valve 13b and its other end abutting with an operation portion of the operation lever 15b. The through hole 24b extends from an inlet communicating with the branch air flow passage R4 divided from the main air flow passage R connected to the air supply source 4, on the other hand, to an outlet communicating with the connection passage 28. The operation rod 26b is disposed so as to allow the inlet of the through hole 24b to communicate with the outlet thereof, when the throttle valve 13b is pressed in resistance to the spring 25b by pressing the operation lever 14b, thereby opening the through hole 24b and allowing the air to pass through the hole 24b from the air supply source 4 to the connection passage 28.

With the arrangement of the air supply valve V1 in association with the first operation unit 14 and the second operation unit 15 in the manner as described hereinabove, the operation of each of the first operation unit 14 and the second operation unit 15 can supply air to the cylinder chamber 17 of the air supply valve V1 through the connection passages 27 and 28, respectively, in the amount in proportion to the degree of opening of the variable throttle valves 13a and 13b, thereby sliding the main spool 12 in the cylinder chamber 17 so as to vary the opening area of the variable aperture 10a or 10b. It is to be noted herein that the pressure created in the cylinder chamber 17 acting as the force for sliding the main spool 12 is determined primarily by a ratio of the opening area of each of the variable throttle valves 13a and 13b of the respective operation units 14 and 15 to the opening area of the respective restriction holes 21a and 21b of the main spool 12, respectively.

When the air is fed to the cylinder chamber 17 by operating the first operation unit 14 by pressing the operation lever 14b, the air is introduced into the cylinder chamber 17 from the air supply source 4 via the connection passage 27 and causes the main spool 12 to slide downward, when seen in the accompanying drawings, in resistance to the spring action of the spring 22a disposed in the first space Q1 until the sliding movement of the main spool 12 is brought to the point that exists in equilibrium between the driving force caused by the pressure within the cylinder chamber 17 and the reaction force of the spring 20a. The downward sliding movement of the main spool 12 causes the variable aperture 10a to open and the extent of opening the variable aperture 10a complies with the air supplied and introduced into the cylinder chamber 17 from the air supply source 4 through the connection passage 27 by operating the first operation unit 14. In other words, the amount of the air supplied into the cylinder chamber 17 to slide the main spool 12 is in proportion to the amount of the air supplied from the air supply source 4 via the first operation unit 14, i.e. the opening area of the variable throttle valve 13a of the first operation unit 14. The air passing through the variable aperture 10a is then fed to the air motor 5 through the inlet 5a for rotating the air motor 5 in a normal direction. The amount of the air to be fed to the air motor 5 is proportional to the amount of the air passing through the variable aperture 10a, in other words, to the opening area of the variable aperture 10a. Further, it can be said that the air motor 5 is caused to rotate at a speed in proportion to the amount of the air supplied thereto from the air supply valve V1.

On the other hand, when the air is introduced into the cylinder chamber 17 from the air supply source 4 by pressing the operation lever 15b of the second operation unit 15, the main spool 12 is caused to slide upwardly, when seen in the accompanying drawings, in resistance against the spring 22b disposed in the second space Q2, thereby opening the variable aperture 10b to the extent in proportion to the air in the amount introduced into the cylinder chamber 17. The amount of the air introduced thereinto is likewise proportional to the amount of the air to be supplied from the air supply source 4 via the second operation unit 15, i.e. the opening area of the variable throttle valve 13b of the second operation unit 15. The air passing through the variable aperture 10b is then fed to the air motor 5 through the inlet 5b for rotating the air motor 5 in a reverse direction. The amount of the air to be fed to the air motor 5 is proportional to the amount of the air passing through the variable aperture 10b, in other words, to the opening area of the variable aperture 10b. Further, it can be said that the air motor 5 is caused to rotate at a speed in proportion to the amount of the air supplied thereto.

More specifically, when the first operation unit 14 is operated by pressing the operation lever 14b, the variable throttle valve 13a is opened to thereby allow the air to enter into the through hole 24a from the air supply source 4 through the branch air flow passage R3 and the air is then fed to the cylinder chamber 17 via the connection passage 27 and the through hole 29a. The air introduced into the cylinder chamber 17 presses and slide the main spool 12 downwardly, as seen in FIG. 4, in the cylinder chamber 17, thereby opening the variable aperture 10a in varying opening areas in accordance with the amount of the air introduced into the cylinder chamber 17. Through the variable throttle valve 10a is fed the air to the air motor 5 that in turn is caused to rotate at the speed in proportion to the amount of the air fed from the air supply valve V1 thereto. Likewise, when the second operation unit 15 is operated by pressing the operation lever 15*b* downward, the air is allowed to enter into the through hole 24*b* from the air supply source 4 through the branch air flow passage R4 and it is then fed to the cylinder chamber 17 via the connection passage 28 and the through hole 29*b*. The air introduced into the cylinder chamber 17 presses the main spool 12 and slides it in the cylinder chamber 17, thereby varying the opening area of the variable aperture 10*b* in association with the groove passage 39*a* disposed around the outer peripheral side wall of the main spool 12. Through the variable aperture 10*b* is fed the air to the air motor 5 that in turn is caused to rotate at the speed in proportion to the amount of the air fed from the air supply valve V1 thereto.

On the other hand, the air introduced into the first space Q1 via the through hole 23*a* from the cylinder chamber 17 is then discharged via the through hole 21*a* to the rear-side air flow passage 18. Likewise, the air introduced into the second space Q2 via the through hole 23*b* from the cylinder chamber 17 is then discharged via the through hole 21*b* to the rear-side air flow passage 18. The air discharged into the rear-side air flow passage 18 is then discharged through the air flow passage 19.

Figure 5:
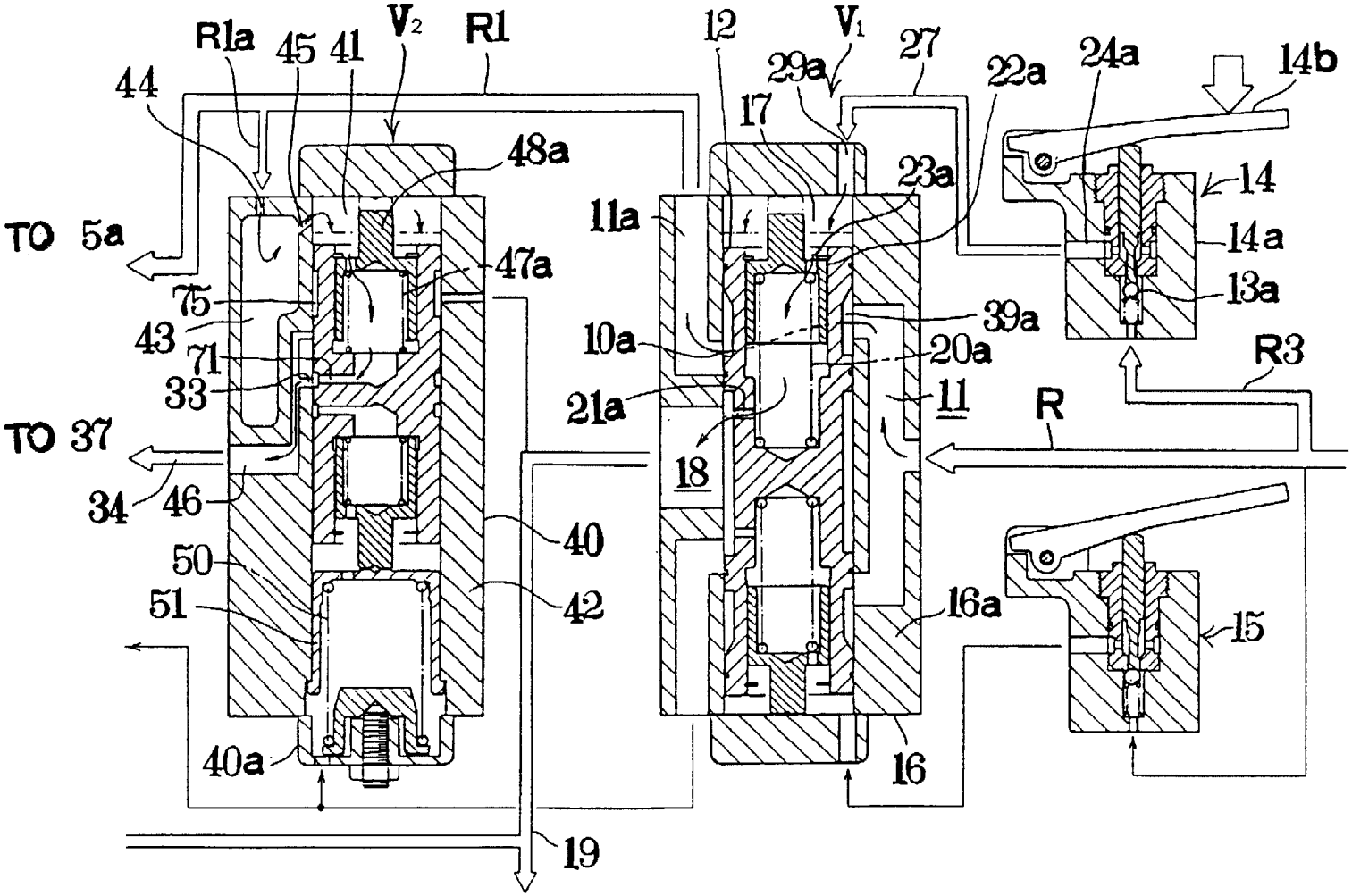
FIGS. 5 and 6 are each a sectional view showing the air amount adjustment mechanism B and the rotation suspension mechanism C for describing operations of the winding machine.

Now, a description turns to the rotation suspending mechanism C with reference to FIGS. 3, 4 and 5.

The rotation suspending mechanism C comprises a brake portion b and a braking valve V2. As specifically shown in FIG. 3, the brake portion b is disposed in such a state as being biased so as to press a braking plate 31 mounted on an end portion of a rotate shaft 6 of the air motor 5 and has a brake piston 32 disposed so as to release the pressure to the braking plate 31 by air pressure. On the other hand, as shown in FIG. 4, the braking valve V2 is connected to the air motor 5 through a branch connection passage R1*a* divided from the connection passage R1. Further, the braking valve V2 is connected to the branch air flow passages 11*a* and 11*b* of the air supply valve V1 through branch connection passages R1*a* and R2*a* of the connection passages R1 and R2, respectively, as well as to the rear-side air flow passage 18 through an air flow passage 19*a*. In addition, the braking valve V2 communicates with an air flow passage 34 connected to the brake portion b through the air motor 5.

More specifically, as shown in FIG. 3, the brake portion b has the braking plate 31 mounted at the one end portion of the rotary shaft 6 of the air motor 5 projecting into a braking cylinder 30 disposed at a one side end of the casing 1. Further, it has the brake piston 32 disposed outside the brake plate 31 via a piston 36 that biases the brake piston 32 toward the brake plate 31 in a normal state. The casing 1 has a conduit 37 disposed over the entire length of the rotary shaft 6 of the air motor 5. The conduit 37 has its front end communicating with the air flow passage 34 connected to the braking valve V2 and its rear end communicating with a conduit 38 disposed in the brake piston 32. The conduit 38 has an opening at its one end, which faces a cylinder chamber 30*a* for the brake portion b, thereby allowing the pressure created by the air supplied from the braking valve V2 to transfer the brake piston 32 in resistance to the biasing force of the spring 36 in the direction in which the brake is released.

A description will now be made of the braking valve V2 with reference to FIG. 4.

As shown in FIG. 4, the braking valve V2 has substantially the same structure as the air supply valve V1. More specifically, the braking valve V2 mainly comprises a cylinder 40 having a thick peripheral wall 42 and the brake spool 35 disposed slidably in a cylinder chamber 41 of the cylinder 40. In the thick peripheral wall 42 of the cylinder 40 is provided an air chamber 43 which in turn is provided on its wall portion at its upstream side with an upstream-side air flow passage 44 communicating with the air supply valve V1 via the branch connection passage R1*a* divided from the connection passage R1, one the one hand, and on its wall portion at its downstream side with a downstream-side air flow passage 45 communicating with the cylinder chamber 41 thereof, on the other hand. The air chamber 43 communicates with the cylinder chamber 41 of the cylinder 40 through the downstream-side air flow passage 45. In the cylinder chamber 41 is disposed the brake spool 35 in which in turn is disposed a spring mount 48*a* that in turn is provided with a through hole communicating with the cylinder chamber 41. Via the through hole disposed in the spring mount 48*a* is connected the cylinder chamber 41 to a third space Q3 formed in the brake spool 35 in association with the spring mount 48*a*. The third space Q3 with the spring 47*a* disposed therein in turn communicates with a through hole 71 disposed in the side wall of the brake spool 35. The through hole 71 can further communicate with the variable aperture 33 disposed in the outer peripheral side wall portion of the cylinder chamber 41. The variable aperture 33 is then connected to an outlet air flow passage 46 disposed in the thick peripheral wall 42 of the cylinder 40. The variable aperture 46 constitutes an outlet portion of the air flow passage 34.

In the outer peripheral wall portion of the cylinder chamber 41 is further provided a port 73 communicating with the outlet air flow passage 46 and the port 73 in turn is disposed to communicate with a groove passage 75 disposed on an outer peripheral surface of the brake spool 35. The groove passage 75 can communicate with an outlet hole 76 disposed in the side wall portion of the cylinder 40 and the outlet hole 76 in turn communicates with the discharging air flow passage 19.

As shown in FIG. 4, a spring mount 48*b* is disposed in the brake spool 35 disposed in the cylinder chamber 41 on the side opposite to the side at which the spring mount 48*a* is disposed. On the spring mount 48*b* is mounted a spring 47*b*. The brake spool 35 forms a fourth space Q4 in association with the spring mount 48*b* mounted on the inner peripheral side wall thereof and the fourth space Q4 communicates with a through hole 72 that in turn can communicate with the variable aperture 33.

On the spring mount 48*b* is further mounted a spring mount 51 in abutment with the spring mount 48*b* at the side opposite to the side facing the spring mount 48*a*. In the spring mount 51 is mounted a spring 50 fixed with an adjusting screw 49 to a cylinder cover 40*a* which in turn is provided with a through hole 44*a* communicating with the connection passage R2.

Then, a description will be made of the operations of the winding machine A in accordance with the present invention for winding goods, particularly of the operations of the air amount adjustment mechanism B and the rotation suspending mechanism C, with reference to FIGS. 4 through 7.

FIG. 4 shows the initial stage of the winding machine A in which it is not in process of operation. In this initial stage, the variable throttle valve 13*a* of the first operation unit 14 and the variable throttle valve 13*b* of the second operation unit 15 are closed to full extent.

In order to wind goods in an upward direction, the air motor 5 is rotated in the normal direction. For rotating the air motor 5 in the normal direction, the air has to be supplied to the air motor 5 through the inlet 5*a* from the air supply valve V1 via the connection passage R1 by operating the first operation unit 14. More specifically, as shown in FIG. 5, the operation lever 14*b* of the first operation unit 14 is pressed to open the variable throttle valve 13*a* and supply air from the air supply source 4 to the air supply valve V1. When the variable throttle valve 13*a* is open, the air is fed from the air supply source 4 to the first operation unit 14 via the branch air flow passage R3 divided from the main air flow passage R connected to the air supply source 4. The air introduced into the first operation unit 14 is then supplied via the through hole 24*a* to the air supply valve V1 through the connection passage 27. The air supplied to the air supply valve V1 is then introduced into the cylinder chamber 17 via the through hole 29*a* and then allowed to pass via the through hole 23*a* disposed in the spring mount 22*a*, followed by transmission into the first space Q1. When the air is introduced into the cylinder chamber 17, the main spool 12 is caused to slide in the cylinder chamber 17 downward, as seen in FIG. 5, and the groove passage 39*a* of the main spool 12 is allowed to communicate with the branch air flow passage 11*a*. The air fed to the first space Q1 is then forced to pass into the rearside air flow passage 18 via the through hole 21*a* disposed in the main spool 12 and then discharged through the air flow passage 19.

Once the groove passage 39*a* disposed on the outer peripheral wall surface of the main spool 12 communicates with the branch air flow passage 11*a*, the groove passage 39*a* also communicates with the air flow passage 11 connected to the air supply source 4 via the main air flow passage R. Therefore, the air is supplied to the branch air flow passage 11*a* from the air supply source 4 and then to the inlet 5*a* of the air motor 5 via the connection passage R1 communicating with the branch air flow passage 11*a* of the air supply valve V1. It is to be noted herein that the air is supplied to the air motor 5 in the amount proportional to the opening area of the variable aperture 10*a* varying in association with the downward sliding movement of the main spool 12, which is disposed at the connection between the branch air flow passage 11*a* and the groove passage 39*a*. As a result, it can be said that the air motor 5 is rotated in the normal direction at the speed in accordance with the amount in which the first operation unit 14*b* is pressed.

In other words, the air introduced into the cylinder chamber 17 from the air supply valve V1 has the pressure to thereby press the main spool 12 disposed in the cylinder chamber 17 in a downward direction, as seen in FIG. 5. As the main spool 12 is caused to slide downwardly, the groove passage 39*a* disposed around the main spool 12 starts agreeing with the variable aperture 10*a*, thereby allowing the branch air flow passage 11*a* to communicate with the front-side air flow passage 11 and the air from the air supply source 4 to pass through the air supply valve V1 toward the air motor 5. To the front-side air flow passage 11 of the air supply valve V1 is supplied the high-pressure air from the air supply source 4 through the main air flow passage R.

It is to be noted herein that the pressure created by the air introduced into the cylinder chamber 17 from the first operation unit 14 is determined primarily by the ratio of the opening area of the variable throttle valve 13*a* of the first operation unit 14 to the opening area of the through hole 21*a* of the main spool 12. The pressure created causes the main spool 12 to slidably move to the equilibrium point at which the driving force of the main spool 12 is balanced with the reaction force of the spring 20*a*, thereby opening the variable aperture 10*a* in association with the groove 39 disposed on the outer peripheral surface of the main spool 12.

As shown in FIG. 5, a portion of the air passing through the connection passage R1 is fed through the branch connection passage R1*a* to the air flow passage 34. More specifically, the portion of the air is introduced from the branch connection passage R1*a* of the connection passage R1 into the air chamber 43 of the braking valve V2 through the upstream-side air flow passage 44 disposed in the wall portion of the braking valve V2. The air introduced into the air chamber 43 is then led to the cylinder chamber 41 through the downstream-side air flow passage 45 disposed in the wall portion of the air chamber 43, thereby sliding the brake spool 35 downwardly in the third space Q3 in resistance to the first pre-load spring 47*a*. The air is then discharged to the outlet passage 46 through the variable aperture 33, followed by supply to the air flow passage 34 and then to the conduit 37 of the air motor 5. A series of the air flow passages through which the portion of the air passing through the connection passage R1 can function as an attenuation circuit that can reduce or eliminate an instantaneous variation in pressure even if such a variation would be caused to occur, for example, due to an impact at the time of starting the air motor 5 up or due to a pulsation flow during rotation of the air motor 5. This can improve an extent of accuracy and stability in the operations of the air motor 5.

When the brake spool 35 is caused to slide in the cylinder chamber 41 until it abuts with the one end of the spring mount 48*a* disposed in the third space Q3, the variable aperture 33 is open to full extent. The air introduced into the cylinder chamber 41 is then fed to the third space Q3 via the through hole disposed in the wall portion of the spring mount 47*a* and then discharged from the third space Q3 to the outlet passage 46 via the through hole 71 of the brake spool 35 and then via the variable aperture 33 of the cylinder 40 for the braking valve V2.

The air discharged to the outlet passage 46 is then supplied to the air motor 5 via the air flow passage 34. More specifically, the air supplied from the air flow passage 34 is then introduced into the conduit 37, followed by the supply to the braking cylinder chamber 30*a* via the piston conduit 38. The air introduced into the braking cylinder chamber 30*a* is then forced to press the brake piston 32 in resistance to the biasing force of the spring 36.

Therefore, as the air motor 5 is allowed to start up when the torque for driving the motor to be caused to occur by the pressure for operating the motor supersedes the sum of the load torque and the reduced brake torque, the air motor 5 can be started up by the operating pressure corresponding to the load. Accordingly, the air motor 5 can be started up in a smooth way without causing the goods to be wound downward due to the reverse rotation of the load that may be likely to occur at the time of start-up, regardless of a high load or a low load. Further, the air motor 5 can be operated at a very slow speed.

Figure 6:
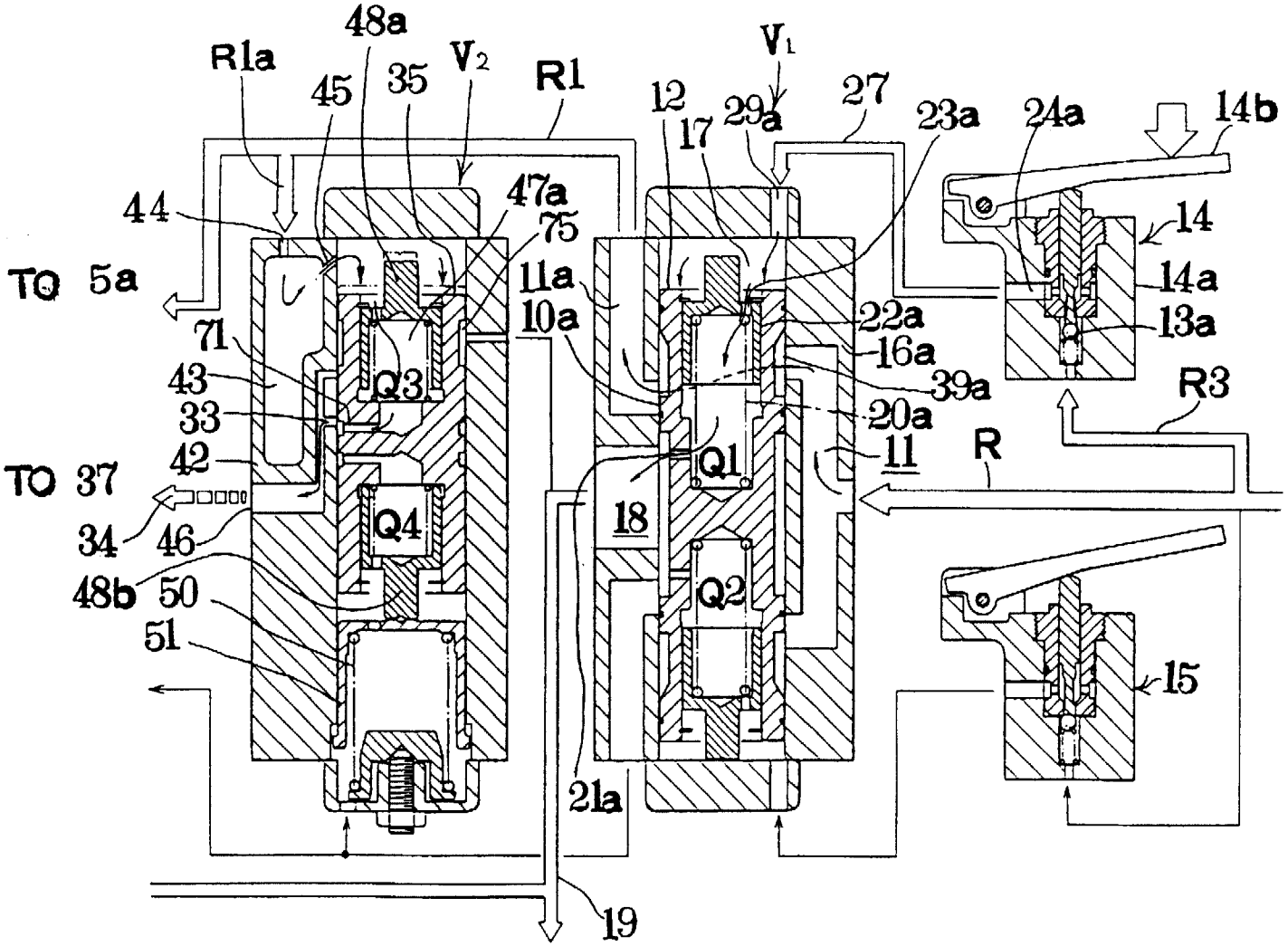
Figure 7:
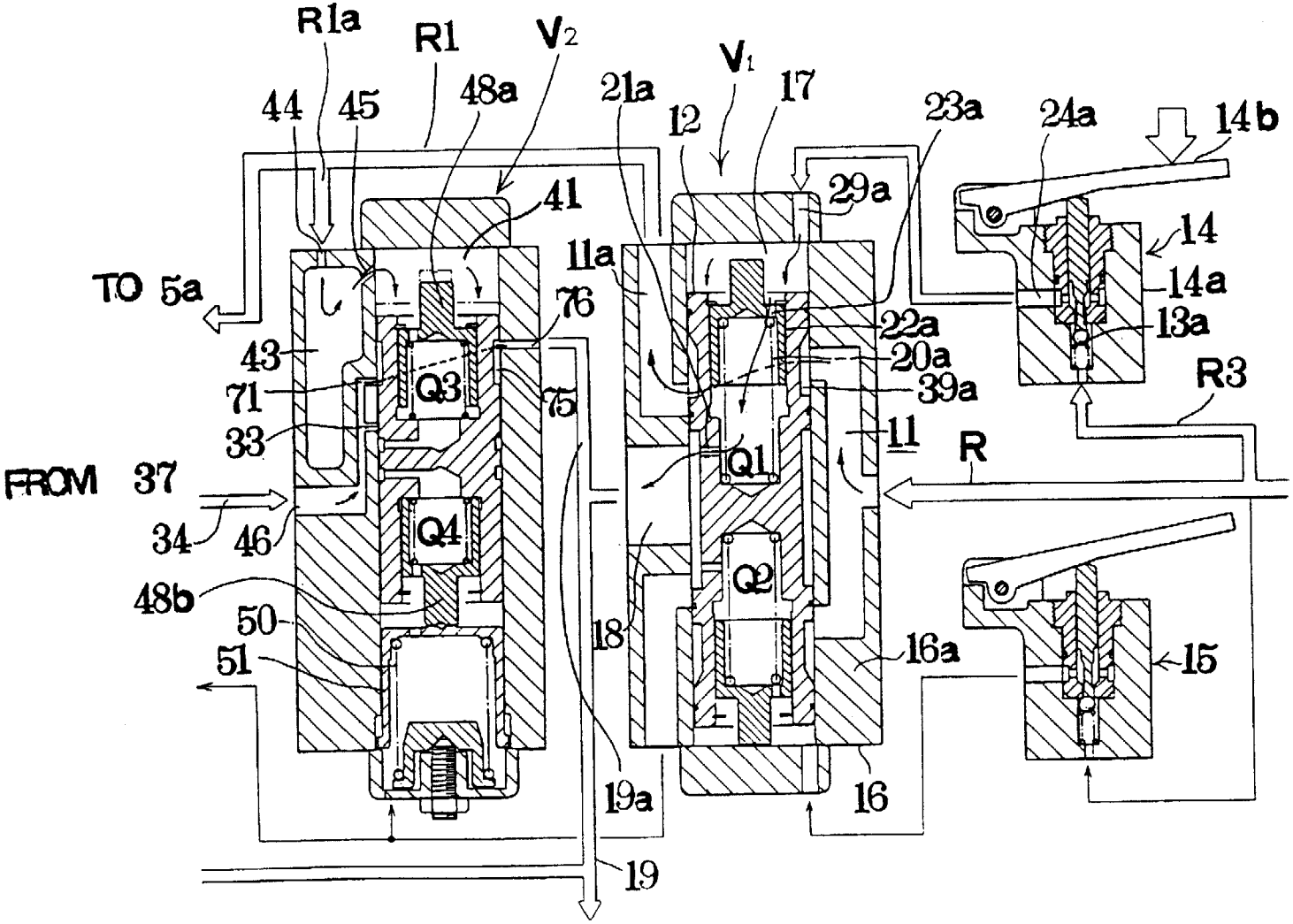
FIG. 7 is a sectional view showing the air amount adjustment mechanism B and the rotation suspension mechanism C particularly for describing operations of the rotation suspension mechanism C.

If the pressure within the braking cylinder chamber 30*a* would exceed the overload operation pressure of the air motor 5, the pressure within the cylinder chamber 41 of the braking valve V2 is also increased relatively, thereby causing the brake spool 35 to further slide and displace in the cylinder chamber 41 in resistance to the pre-loaded spring 50 and to pass through the full open point at which the variable aperture 33 is full open. When the brake spool 35 slides passing through the full open point, the amount of the air coming to the variable aperture 33 is decreased in reverse proportion to the increment of the operating pressure of the air motor 5. More specifically, as shown in FIG. 6, when the amount of the air passing through the connection passage R1 is increased so as to cause the pressure within the braking cylinder chamber 30*a* to exceed the overload operation pressure of the air motor 5, the amount of the air flowing through the branch connection passage R1*a* into the air chamber 43 is also increased elevating the pressure within the cylinder chamber 41 and consequently pressing and sliding the brake spool 35 in a downward direction, as seen in FIG. 6. As the brake spool 35 slides downwardly in resistance to the spring 50, the through hole 71 disposed in the brake spool 35 starts communicating with the variable aperture 33 and reaches the full open point at which the entire opening area of the through hole 71 agrees fully with the entire opening area of the variable aperture 33. As the brake spool 35 is further displaced over the full open point, the opening area of the through hole 71 corresponding to the opening area of the variable aperture 33 becomes smaller again and the amount of the air passing through the variable aperture 33 is caused to be decreased although the pressure within the cylinder chamber 41 is caused to be increased. As a result, the pressure within the braking cylinder chamber 30*a* becomes lower than the pressure within the cylinder chamber 41 of the braking valve V2 so that the brake torque is caused to be increased. As the brake torque is increased, the operating pressure of the air motor 5 is also increased, thereby causing the pressure within the cylinder chamber 41 of the braking valve V2 to further increase. As the pressure within the cylinder chamber 41 continues increasing, the brake spool 35 also continues sliding and displacing in resistance to the biasing force of the spring 50 until the spring mount 51 of the spring 50 becomes in close abutment with the cylinder cover 40*a*, as shown in FIG. 7.

As the brake spool 35 is caused to be displaced and slide downwardly past the full open point of the through hole 71 communicating with the variable aperture 33, the groove passage 75 disposed around the brake spool 35 becomes communicating with the port 73. As the port 73 communicates with the outlet passage 46, the air discharged from the braking cylinder chamber 30*a* via the conduits 38 and 37 of the air motor 5 can be discharged from the braking valve V2 via the outlet passage 46, the groove passage 75, the outlet hole 76 and the branch air flow passage 19*a* to the discharging air flow passage 19.

When the pressure within the braking cylinder chamber 30*a* is allowed to be discharged, the brake piston 32 is caused to be pressed by the spring 36, thereby braking the air motor 5 to full stop.

Now, a brief description will be made of the action of lowering the goods by winding the chain 2 downwardly.

As shown in FIG. 3, the second operation unit 15 is operated by pressing the operation lever 15*b* when the goods wound upwardly by the winding machine A is to be lowered by winding the chain 2 downwardly.

As shown in FIG. 4, when the operation lever 15*b* is pressed to open the variable throttle valve 13*b*, the air is allowed to enter into the second operation unit 15 from the air supply source 4 via the branch air flow passage R4 and then fed to the air supply valve V1 via the through hole 24*b* of the second operation unit 15 and the connection passage 28. The air from the connection passage 28 enters into the cylinder chamber 17 via the through hole 29*b* disposed in the cylinder cap on the side of the spring mount 22*b*. The pressure caused by the air entering into the cylinder chamber 17 presses and slides the main spool 12 upwardly, as seen in FIG. 3. The air entering into the cylinder chamber 17 further continues flowing into the second space Q2 via the through hole 23*b* disposed in the wall portion of the spring mount 22*b*. As the through hole 21*b* disposed in the main spool 12 is brought into agreement with the rear-side air flow passage 18 upon the upward sliding movement of the main spool 12, the air entering into the second space Q2 is discharged to the rearside air flow passage 18 via the through hole 21*b*.

As the air entering into the cylinder chamber 17 increases, the main spool 12 is further sliding upwardly upon a gradual increase in the air pressure within the cylinder chamber 17 and the groove passage 39*b* disposed around the outer peripheral side wall of the main spool 12 is allowed to communicate with the branch air flow passage 11*b* that in turn communicates with the inlet 5*b* of the air motor 5. Once the groove passage 39*b* of the main spool 12 communicates with the branch air flow passage 11*b*, the air supply source 4 communicates with the branch air flow passage 11*b* via the groove passage 39*b*, the front-side air flow passage 11 and the main air flow passage R, thereby allowing the air to enter into the branch air flow passage 11*b* from the air supply source 4 and then to be fed via the connection passage R2 to the air motor 5 through the connection passage 28.

It is to be noted herein, too, that the amount of the air to be fed through the connection passage R2 to the air motor 5 from the branch air flow passage 11*b* of the air supply valve V1 is proportional to the amount of the air entering through the second operation unit 15. In other words,.the amount of the air fed to the air motor 5 is in proportion to the opening area of the variable aperture 10*b* of the air supply valve V1, that is, in proportion to the opening area of the variable throttle valve 13*b* of the second operation unit 15.

The air entering into the inlet 5*b* of the air motor 5 can rotate the air motor 5 in the reverse direction, that is, in the direction opposite to the direction in which the air motor 5 is rotated by the air entering into the inlet 5*a*. The rotation of the air motor 5 in the reverse direction can wind the chain 2 downward to thereby lower the goods.

A portion of the air flowing through the connection passage R2 is fed to the braking valve V2 via the branch connection passage R2*a*. The portion of the air is introduced into the cylinder chamber 41 of the braking valve v2 via the through hole 44*a* disposed in the cylinder cap 40*a* on the side of the spring mount 51 and the pressure created by the air entering into the cylinder chamber 41 presses the spring mount 51 that eventually presses the brake spool 35 through the spring mount 48*b* connected to the spring mount 51. As the brake spool 35 is caused to slide upwardly, as seen in FIG. 4, the through hole 72 communicating with the fourth space Q4 becomes communicating with the variable aperture 33 disposed in the cylinder wall portion of the cylinder 40. This arrangement of the brake spool 35 can supply the air in the cylinder chamber 41 to the air motor 5 via the air flow passage 46 of the braking valve V2. More specifically, the air entering into the spring mount 51 of the cylinder chamber 41 through the hole 44*a* from the branch connection passage R2*a* is then fed to the cylinder chamber 41 via a hole disposed in the wall portion of the spring mount 51, followed by entering into the fourth space Q4 via a hole disposed in the spring mount 48*b*. The air entering into the fourth space Q4 is then fed to the air motor 5 via the through hole 72, the variable aperture 33, the air flow passage 46 and the air flow passage 34.

The air supplied to the air motor 5 via the air flow passage 34 is allowed to pass through the conduit 37 to the braking cylinder chamber 30*a* in substantially the same manner as the air is fed thereto by operating the first operation unit 14 in the manner as described hereinabove.

As shown in FIG. 3, a hole communicating with the conduit 38 is disposed in the brake piston 32 communicating with the air flow passage 19.

The other operations necessary for winding the goods downwardly can be performed in substantially the same manner as the operations for winding the goods upwardly.

With the arrangement of the winding machine A in accordance with the present invention in the manner as described hereinabove, it can offer the advantages and features as will be described hereinafter.

EFFECTS OF THE INVENTION

The winding machine in accordance with the present invention presents the advantage that the predetermined speed of rotation of the air motor can be gained by operating the operation unit. As the operation unit is provided with the built-in variable valve that can control the amount of the air to be supplied to the air supply valve simply by the operation of the lever of the operation unit, it can supply the air to the air supply valve in the amount corresponding to the amount of operation of the operation unit. The air fed to the air supply valve causes the main spool disposed therein to slide in the cylinder chamber thereof in accordance with the amount of the air fed thereto. As the main spool slides, the variable aperture disposed in the air supply valve is allowed to open to such an extent as corresponding to the amount of the sliding movement of the main spool which in turn corresponds to the opening area of the variable valve disposed in the operation unit. The air discharged from the air supply valve is then fed to the air motor that in turn is rotated at the speed in accordance with the amount of the air fed thereto from the air supply valve. That is, the speed of rotation of the air motor corresponds to the extent of the opening area of the variable aperture of the air supply valve that in turn corresponds to the extent of the opening area of the variable valve disposed in the operation unit.

As the amount of the air required for causing the main spool disposed in the air supply valve to slide for adjusting the amount of the air to be supplied to the air motor is so small, a flexible tube having a small diameter can also be utilized for the air flow passage connecting the air supply source to the operation unit and the air flow passage connecting the air supply valve to the air motor. Thus, the winding machine in accordance with the present invention can be remotely controlled with ease.

The winding machine in accordance with the present invention is provided with the rotation suspending mechanism for suspending the rotation of the air motor by detecting the overload of the air motor. As the amount of the air supplied to the air motor can be adjusted so as to be variable in accordance with the amount of the sliding movement of the brake spool of the braking valve, the torque for driving the motor can be applied by the operating pressure of the air motor in accordance with the load and, at the same time, the brake torque can also be decreased. Therefore, the air motor can be started up smoothly without causing any reverse rotation of the motor due to the load at the time of the start-up. Further, the winding machine can be operated at a very slow speed.

Further, the winding machine in accordance with the present invention can simplify the entire structure because the operations starting with sensing of the overload and suspending the air motor can be performed by a series of the actions of the brake spool.

Furthermore, the winding machine in accordance with the present invention can improve responsiveness to the operations at high sensitivity to the overall operations from sensing of the overload until the suspension of the air motor.

A series of the air flow passages through which the portion of the air entering into the braking valve can function as an attenuation circuit that can reduce or eliminate an instantaneous variation in pressure even if such a variation would be caused to occur, for example, due to an impact at the time of starting the air motor up or due to a pulsation flow during rotation of the air motor. This can improve an extent of accuracy and stability in the operations of the air motor.

In addition, no silencer is required to be mounted separately because the air discharged from the braking valve is combined with the air discharged from the air motor.

What is claimed is:

1. A winding machine comprising:

a winding portion having a chain wound therein for hanging goods;

an air supply source;

an air motor for rotating said winding portion by air to be supplied from said air supply source;

an air amount adjustment mechanism for controlling a speed of rotation of said air motor interposed between said air motor and said air supply source; and a rotation suspending mechanism for suspending rotation of said air motor;

wherein said air amount adjustment mechanism comprises an air supply valve and an operation unit;

wherein said air supply valve comprises a variable aperture; an air flow passage connecting said air supply source to said air motor through said variable aperture; and a spool disposed so as to slide within said air supply valve; in which an opening of said variable aperture is variable in accordance with an amount in which said spool slides;

wherein said operation unit is disposed to slide said spool by supplying air to said air supply valve from said air supply source through a variable valve disposed therein so as to be variable in an opening area thereof; and wherein said rotation suspending mechanism comprises a brake portion and a braking valve; in which said brake portion is provided with a brake piston biased so as to press a braking plate mounted on an end portion of a rotary shaft of said air motor and to release pressing of the braking plate by means of pressure of air and in which said braking valve has a brake spool disposed therein and an air flow passage connecting said air supply source to said brake portion through a variable aperture and having said air flow passage disposed therein so as to be variable in the opening area thereof through which air passes in an amount varying in accordance with an amount in which said brake spool slides.

2. A winding machine as claimed in claim 1, wherein said operation unit comprises an operation unit for rotating said air motor in a normal direction and an operation unit for rotating said air motor in a reverse direction.

3. A winding machine as claimed in claim 1, wherein:

said air supply valve of said air amount adjustment mechanism has a cylinder having a chamber with the spool disposed so as to be slidable therein; the cylinder has a wall having said air flow passage connecting said air supply source to said air motor through the chamber thereof and the variable aperture is disposed at a joint portion connecting the air flow passage to the chamber; and said operation unit of said air amount adjustment mechanism is provided with the variable valve for supplying air to the chamber of said air supply valve and an opening area of the variable valve is disposed so as to be variable in accordance with an amount in which the spool slides in the chamber of said air supply valve.

4. A winding machine as claimed in claim 1, wherein:

the brake portion of said rotation suspending mechanism is provided with the brake piston biased so as to press the braking plate mounted on an end portion of the rotary shaft of said air motor and to release pressing of the braking plate by means of pressure of air; and the braking valve has a braking cylinder disposed therein; the brake spool disposed therein so as to be slidable in the cylinder chamber; an air chamber disposed in a wall portion thereof having a first air flow passage communicating with said air supply source and a second air flow passage communicating with the cylinder chamber; and the variable aperture disposed in the wall portion thereof connecting the cylinder chamber to the braking cylinder.

* * * * *